United States Patent [19]

Taxil et al.

[11] 4,021,696

[45] May 3, 1977

[54] ULTRAVIOLET DISCHARGE LAMP

[75] Inventors: Andre Marc Victorin Taxil, Paris; Jacques Clement Divoux, Mesnil-le-Roi; Joseph Henri Demaeyer, Villiers St Frederic, all of France

[73] Assignee: ITT Industries, Inc., New York, N.Y.

[22] Filed: Feb. 6, 1976

[21] Appl. No.: 656,053

[30] Foreign Application Priority Data

Feb. 14, 1975 France ..... 75.04586

[52] U.S. Cl. ..... 313/229; 313/225; 313/223; 313/185; 313/186

[51] Int. Cl.[2] ..... H01J 61/18

[58] Field of Search ..... 313/229, 185, 186, 187

[56] References Cited

UNITED STATES PATENTS 3,772,557 11/1973 Yoshida et al. ..... 313/229

*Primary Examiner*—Rudolph V. Rolinec
*Assistant Examiner*—Darwin R. Hostetter
*Attorney, Agent, or Firm*—John T. O'Halloran; P. C. Van Der Sluys; R. A. Menelly

[57] ABSTRACT

An ultraviolet lamp provides radiation in the 240 to 313 millimicron range for polymerizing photosensitive inks. Accurate quantities of metals and halides are provided by introducing stable gaseous organic compounds of the halogens and reacting the organic compounds with the desired metals to produce their halides.

12 Claims, 1 Drawing Figure

ULTRAVIOLET DISCHARGE LAMP

BACKGROUND OF THE INVENTION

The present invention relates to discharge lamps with an internal ionizable atmosphere containing mercury vapor, the vapor of at least one metal selected from group III A of the periodic table of elements, and at least one rare gas. It is characterized by the fact that this atmosphere also contains a halogenated organic compound, which combines with the selected metal when the tube is fully operating.

The invention relates more particularly to a lamp operating at medium pressure and rich in ultraviolet radiation. This lamp is used as a source of ultraviolet radiation for producing photo-chemical reactions, such as in particular the polymerization of polymerizable inks and varnishes used by printers or for coating the surfaces of objects of various materials such as wood, tissue, plastic or metallic materials, etc.

Among the various known advantages resulting from the processing of polymerizable inks and varnishes by ultraviolet radiation, mention may be made of the savings in power, the high processing speed and the reduction in pollution (noise and odors).

In general, earlier ultraviolet lamps were designed to meet the requirements of photographic or photosensitive papers. Compared to tests made with variable-spectrum lamps, it was found preferable for the polymerization of polymerizable inks and varnishes to provide a lamp whose radiated power in the 240 to 313 millimicrons ultraviolet is high with respect to that in the 334 to 408 millimicron ultraviolet range. The development of a lamp meeting these requirements constitutes a first objective of the invention.

In earlier techniques for printing drawings or copies, photographic or photosensitive paper was exposed by means of mercury-vapor lamps, whose maximum radiated energy was in the 365 to 407 millimicron range. In order to increase the intensity of the ultraviolet radiation, the spectral width had to be enlarged. This was achieved by adding metallic elements and a pure halogen, or again by means of metallic halides. A known method was to use, for example, metallic gallium and gaseous iodine or chlorine, or again a gallium halide in the form of gallium tri-iodide. A known disadvantage of these substances is the difficulty in adjusting the very small quantities required and of introducing them into the lamp. This is particularly true when chemically unstable compounds such as gallium tri-iodide as employed. Industrially, there is a danger of excessive statistical dispersion of the composition about the ideal or required values initially specified.

In another former type of UV lamp, the radiated spectrum was widened by associating metallic gallium and mercury iodide with the mercury. When this lamp was started, it was found that the mercury iodide decomposed into mercury and iodine, and that the iodine recombined with the gallium to produce gallium iodide. This method avoided the handling and measuring of gallium iodide or iodine.

One of the purposes of the invention is to overcome the above sources of error, by the introduction of a halide in the form of a stable compound easily measured.

Another purpose is to reduce losses in the lamp by reducing visible and infra-red radiation as far as possible, as well as far ultraviolet radiation which produces ozone.

SUMMARY OF THE INVENTION

The present invention reveals that in the presence of mercury vapor and at least one of the following: one halogenated organic compound in the discharge atmosphere, one pure metal selected from one of the following three in group III A of the periodic table (gallium, aluminum and indium), and one rare gas, an electrical discharge lamp could be produced, particularly suitable for solving the problem of polymerizing polymerizable inks and varnishes.

One characteristic of the present invention resides in the fact that the iodine is provided in the form of a halogenated organic compound which can be introduced into the lamp in gaseous form at ambient temperature, and in the fact that its volume and pressure may be easily controlled and measured in an accurate manner. Another characteristic of the invention is due to the fact that the metal selected may be introduced in relatively inaccurate quantities into the lamp, the only condition being that the amount exceeds a predetermined minimum amount, the upper limit being at least double without notably influencing the operation or behavior of the lamp.

For suitable quantities of substances introduced in the lamp, the latter produces uniform radiation over the whole length of arc between the electrodes, even when its length is increased up to 2 meters. This is an advantage over certain former lamps, whose tubes were filled with a free halogen, such as iodine, and a metallic element, such as gallium. In these lamps, the spectral distribution and ultraviolet radiation level in the region close to the two electrodes and the central region of the tube were not uniform.

Another characteristic of this lamp is due to the fact that the halogenated organic compound introduced into the tube prevents the formation of opaque deposits in the cooler parts of the lamp when the latter is operating normally. Consequently, this compound helps to preserve the initial uniform radiation. It appears probable that this contribution is due at least partially to the role played by the organic radical of this compound.

Other characteristics of the invention will emerge from the detailed description below. It should be understood that the description and drawing are given as examples only, and in no way limit the scope of the invention.

DESCRIPTION OF THE PREFERRED EMBODIMENT

Figure 1:
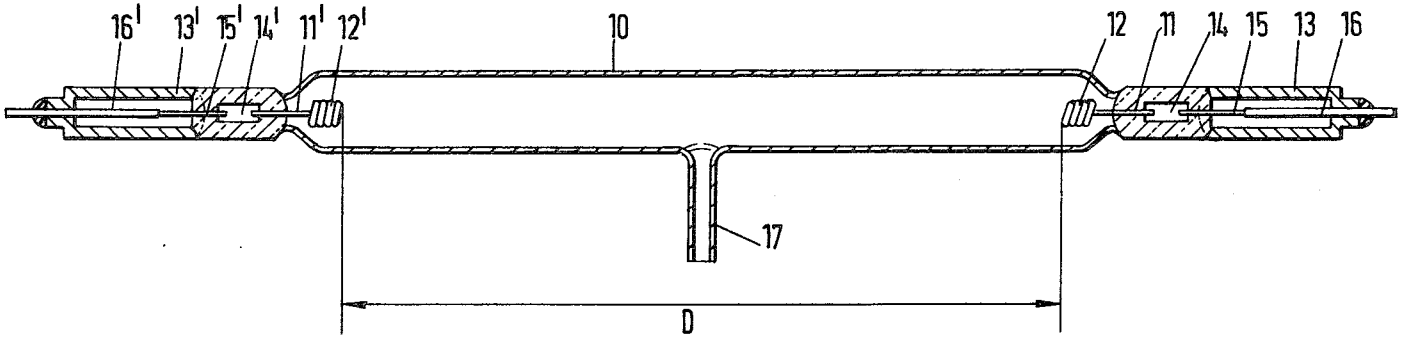
FIG. 1 is a schematical longitudinal cross-section of a preferred version of the ultraviolet lamp according to the invention.

A preferred practical application of the invention can be seen in FIG. 1 where the lamp consists of a cylindrical tube 10 made of very pure silica and very transparent to ultraviolet radiation. Its diameter is preferably 18 to 22 mm. It may have a length of up to 2 meters for powerful lamps of the order of 25 kilowatts. The tungsten electrodes 11 and 11′ are sealed in the narrowed ends of the tube, their spirals 12 and 12′ in the tube space being coated with thorium. The other ends of these electrodes 11 and 11′ are connected to the external end pieces 13 and 13′ of nickel or nickel-plated steel by means of the molybdenum foil conductors 14 and 14'. These are sealed in the axial holes of the silica tube 10. The molybdenum conductors 15 and 15' connect the molybdenum foils 14 and 14' to the copper braids 16 and 16'. Each of these braids 16 and 16' passes throgh an axial hole in the corresponding end-piece 13 or 13', and are braised at their exits on these end-pieces. These end-pieces 13 and 13' are preferably of the type described and claimed in the French patent filed by the present applicants on Apr. 11, 1974 under the French Pat. No. 74 12 746.

It is obvious that the distance D between the electrodes is a function of the required lamp power. If a lamp having a total power of 7.5 kilowatts is required, this inter-electrode distance is preferably 970 mm.

The tube is filled as follows. Predetermined quantities of mercury and of a metallic element selected from one of the elements: gallium, indium or aluminum are introduced by a neck 17, and the tube is then pumped out in the conventional mannner. A certain volume of a halogenated organic compound in the gaseous state at ambient temperature is added by a tube connected to the neck. This compound may be an iodized organic compound such as methyl iodide ($CH_3I$) or ethyl iodide ($C_2H_5I$). They are fed into the enclosure at a suitable pressured adjusted between 0.1 and 0.8 torr. The enclosure is then filled by at least one of the two rare gases, argon or neon, and the neck 17 is then sealed.

In the previous example of a lamp designed to have a power of 7.5 kilowatts, the metallic element selected and introduced in the tube is preferably gallium, its quantity being proportional to that of the mercury and the selected halogenated organic compound. The typical composition in the enclosure of a 7.5 kilowatt tube consists of at least 0.15 mg of gallium, 430 mg of mercury, a methyl iodide filling at a pressure of 0.15 torr and afterwards of argon under a pressure of 20 torr.

For a tube having an internal diameter of 20 mm, these quantities represent approximately $6 \times 10^{-4}$ mg of gallium and 1.80 mg of mercury per cm3 of the tube. This quantity of gallium per cm3 is the minimum necessary value for correct operation of the tube, but this quantity may be greater, even double for example, without affecting the operation or behavior of the lamp.

At ambient temperature, the gallium and mercury are condensed, while the methyl or ethyl iodide and the rare gas are gaseous. The same results may be obtained when the quantity of gallium is replaced by a corresponding quantity of aluminum or indium, i.e. by $2.4 \times 10^{-4}$ to $4.8 \times 10^{-4}$ mg of aluminum or $1 \times 10^{-3}$ to $2 \times 10^{-3}$ mg of indium per cm3.

The lamp possessing the means described above may be operated by applying a supply voltage of 1225 V across the two electrodes, the load current being 6.75 A. An arc is first established in the rare gas between the two electrodes. The energy dissipated then heats the tube, evaporating the mercury and gallium. After operating for approximately one minute, the lamp behaves as a lamp with mercury vapor only. After two minutes, the gallium reacts with the halogenated organic compound, and its ultraviolet spectrum is superimposed on that of the mercury. The lamp reaches its normal operating condition after three minutes when the total internal pressure is optimum, i.e. between 1 and 2 atmospheres. The cold points of the silica envelope of the lamp then reach a temperature of 600° to 750° C.

The radiated power in watts per inch (1 inch = 25.4 mm) at the main wave lengths by two examples of lamps fed with a power of 200 watts per inch and 300 watts per inch respectively are given in the following table.

Radiated power in watts per inch at the main wave-lengths.

| | Wave-length in millimicrons | Power supplied 200 W/inch lamp | 300 W/inch Lamp |
|---|---|---|---|
| | 1357/1393. | 0.9 | 1.8 |
| | 1189/1213 | | |
| IR | 1119/1129 | 2.4 | 5.0 |
| | 1014 | 8.3 | 15.0 |
| | 691 | 0.3 | 0.5 |
| | 577/9 | 14.0 | 25.0 |
| | 546 | 15.4 | 29.0 |
| Visible | 492 | 0.2 | 0.5 |
| | 436 | 12.2 | 24.0 |
| | 417 | 8.0 | 15.0 |
| | 408 | 1.0 | 2.0 |
| | 405 | 6.1 | 12.0 |
| UV C | 403 | 4.0 | 8.0 |
| | 391 | 0.2 | 0.5 |
| | 366 | 12.1 | 24.0 |
| | 334 | 1.4 | 3.0 |
| | 313 | 5.5 | 10.0 |
| | 302 | 3.2 | 6.5 |
| | 297 | 2.0 | 4.0 |
| | 294 | 4.0 | 7.0 |
| UV B | 292 | 0.4 | 0.7 |
| | 289 | 0.7 | 1.2 |
| | 287 | 4.0 | 7.0 |
| | 280 | 1.4 | 2.5 |
| | 275 | 0.4 | 0.6 |
| | 270 | 0.7 | 1.2 |
| | 265 | 1.5 | 2.5 |
| | 257 | 2.1 | 4.0 |
| UVA | 254 | 1.0 | 2.0 |
| | 248 | 1.3 | 2.5 |
| | 240 | 1.2 | 2.0 |

The table shows that the sums of the ultraviolet radiated powers A and B reach high values in watts per inch, compared with the ultraviolet radiated powers C. This lamp is therefore suitable for solving the problem of polymerizing polymerizable inks and varnishes.

Compared with a lamp containing only mercury vapor, the improvement in the efficiency of ultraviolet radiation is more than 40% in the useful region between 240 and 408 millimicrons. At the same time, radiation is decreased in the regions of visible light and far ultraviolet beyond 240 millimicrons, thereby decreasing the production of ozone.

The improved efficiency of the lamp in watts radiated with respect to watts supplied also decreases the losses on the silica envelope, dropping its temperature by 50° to 100° C, thereby increasing the life of the lamp.

Although the principles of the present invention are described above in relation with specific practical examples, it should be clearly understood that the said description is given as an example only and does not limit the scope of the invention.

What is claimed is:

1. A mercury-vapor discharge lamp for producing ultraviolet radiation of the type having a quartz tubular sealed envelope, thorium-coated tungsten electrodes, a quantity of mercury, a rare gas such as neon or argon, and a metallic element such as gallium, aluminum or indium, comprising:

a quantity of a halogenated organic compound in the gaseous state capable of reacting with a predetermined quantity of the metallic element when the lamp is operating.

2. The lamp of claim 1 wherein the halogenated organic compound is an iodized compound selected from the group consisting of methane and ethane.

3. The lamp of claim 2 wherein the halogenated compound comprises methyl iodide.

4. The lamp of claim 2 wherein the halogenated compound comprises ethyl iodide.

5. The lamp of claim 3 wherein the methyl iodide is at a pressure of between 0.1 and 0.8 torr at ambient temperature.

6. The lamp of claim 4 wherein the ethyl iodide is at a pressure of between 0.1 and 0.8 torr at ambient temperature.

7. The lamp of claim 1 wherein the metallic element comprises gallium in the range between $6 \times 10^{-4}$ to $12 \times 10^{-4}$ mg per cm3 of the discharge envelope volume.

8. The lamp of claim 1 wherein the metallic element comprises indium in the range between $1 \times 10^{-3}$ to $2 \times 10^{-3}$ mg per cm3 of the discharge lamp volume.

9. The lamp of claim 1 wherein the metallic element comprises aluminum in the range between $2.4 \times 10^{-4}$ to $4.8 \times 10^{-4}$ mg per cm3 of the discharge lamp volume.

10. The lamp of claim 1 wherein the mercury comprises 1.80 mg per cm3 of the envelope volume.

11. The lamp of claim 1 wherein the rare gas comprises argon at a pressure of 20 torr.

12. A mercury vapor discharge lamp of the type having a tubular envelope, a pair of electrodes, a quantity of mercury and a filling of inert gas for use in the polymerization of photochemical compounds comprising:

a halogenated compound selected from the group of iodized organic compounds of methyl iodide and ethyl iodide; and a metal selected from the group consisting of gallium, aluminum and indium for providing ultraviolet radiation in the range of between 240 and 313 millimicrons.

* * * * *